US010013958B2

(12) United States Patent
Satterlee

(10) Patent No.: US 10,013,958 B2
(45) Date of Patent: Jul. 3, 2018

(54) ACCESSORY WEIGHTS AND KITS FOR A BRASS INSTRUMENT

(71) Applicant: Eric Satterlee, Haslett, MI (US)

(72) Inventor: Eric Satterlee, Haslett, MI (US)

(73) Assignee: Eric Satterlee, Haslett, MI (US)

( * ) Notice: Subject to any disclaimer, the term of this patent is extended or adjusted under 35 U.S.C. 154(b) by 0 days.

(21) Appl. No.: 15/446,205

(22) Filed: Mar. 1, 2017

(65) Prior Publication Data

US 2017/0256242 A1 Sep. 7, 2017

Related U.S. Application Data

(60) Provisional application No. 62/302,915, filed on Mar. 3, 2016.

(51) Int. Cl.
*G10D 9/00* (2006.01)
*G10D 7/08* (2006.01)

(52) U.S. Cl.
CPC ..... *G10D 9/00* (2013.01); *G10D 7/08* (2013.01)

(58) Field of Classification Search
CPC ..... G10D 7/08; G10D 3/00
See application file for complete search history.

(56) References Cited

U.S. PATENT DOCUMENTS 6,008,444 A * 12/1999 Chesko ..... G10D 9/04 84/388
7,563,970 B2 * 7/2009 Laukat ..... G10D 7/005 84/380 R

* cited by examiner

*Primary Examiner* — Kimberly Lockett
(74) *Attorney, Agent, or Firm* — Fitch, Even, Tabin & Flannery LLP

(57) ABSTRACT

Accessory weights and kits for brass instruments to reduce sympathetic vibration of a brass instrument. In one embodiment a first weight disposed on a first side of a center brace for a saxophone between the bell and the body; a second weight disposed on a second side of a center brace for a saxophone between the bell and the body; and a connector to attach the first weight to the second weight configured to extend through a bore of the center brace forming an opening. The connector can be a screw that extends through a bore defining an opening in the first weight, through the bore of the center brace, and attached to the second weight by attachment through a threaded bore of the second weight.

10 Claims, 8 Drawing Sheets

ACCESSORY WEIGHTS AND KITS FOR A BRASS INSTRUMENT

CROSS-REFERENCE TO RELATED APPLICATION

This application claims benefit from U.S. Provisional Application No. 62/302,915, filed Mar. 3, 2016, the complete disclosure of which is incorporated herein by reference in its entirety.

FIELD

Accessory weights and kits for brass instruments are described herein and, in particular, accessory weights and kits for brass instruments configured for attachment to a brace of a brass instrument.

BACKGROUND

A musical instrument is a device created or adapted to make musical sounds. The principal types of such instruments are typically classified by the method of producing sound, and can include percussion, stringed, keyboard, wind, and electronic instruments. A saxophone, for example, is a wind instrument and is usually made of brass and played with a single-reed mouthpiece. Brass instruments produce sound by sympathetic vibration of air in a tubular resonator in sympathy with the vibration of the player's lips.

In the art, accessories have been developed to modify, enhance, change and/or dampen the sound of an instrument. Such accessories provide added expression, amplitude and/or quality of sound. For brass instruments, this may include various mouthpiece shapes, muting devices and the like.

Despite development of such accessories, further devices and assemblies are desired to add further tonal variation and even improvement of the sound of a brass woodwind instrument.

SUMMARY

Accordingly, exemplary accessory weights and kits for brass instruments are provided herein and, in particular accessory weights and kits for brass instruments configured for attachment to a brace of a brass instrument.

In one embodiment, a weight assembly to reduce sympathetic vibration of a brass instrument is provided having a first weight disposed on a first side of a center brace for a saxophone between the bell and the body; a second weight disposed on a second side of a center brace for a saxophone between the bell and the body; and a connector to attach the first weight to the second weight configured to extend through a bore of the center brace forming an opening.

The connector can be a screw that extends through a bore defining an opening in the first weight, through the bore of the center brace, and attached to the second weight by attachment through a threaded bore of the second weight. In another approach, the connector can be a magnetic force from the first weight and second weight being made from a ferromagnetic material and at least one of the first weight and second weight are a permanent magnet, the first weight and the second weight configured to be adjacent to each other within at least a portion of the opening of the center brace. Other connectors can include double sided adhesives, hook and loop fasteners, clamps, glues, and the like The weight assembly in one approach can have a removable cover layer over the first weight. Indicia can be added on an outer surface of the cover layer.

In one approach the weight assembly can be preferably in the range of about 70 grams to 150 grams; more preferably in the range of about 100 grams to 120 grams, and most preferably at about 109 grams. The combined weight of the assembly and the center brace can be in the range of about 100 grams to 160 grams or more preferably in the range of about 115 grams to 145 grams.

ELEMENT NUMBERS

Figure 1:
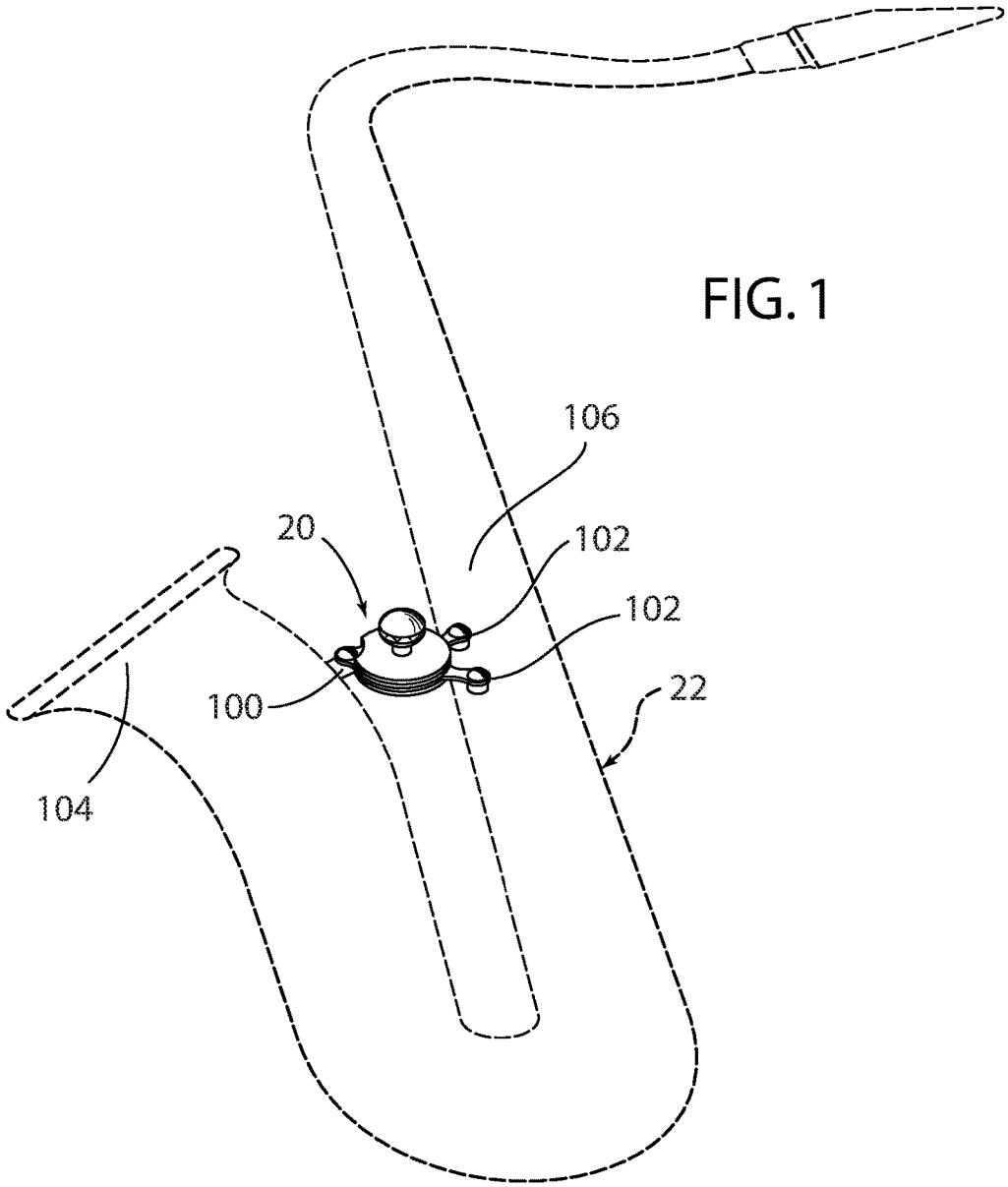
FIG. 1 illustrates a top perspective view of an exemplary embodiment of a weight accessory for a brass instrument.

20 weight accessory for a brass instrument (approx. 109 gms without brace; 128 gms with brace)
22 exemplary instrument (horn)(brass)
24 center brace for a saxophone (bell brace, ring design; bell to body brace) (approx. 19 gms)
26 center brace ring opening
28 center brace connection to point to bell of instrument
30 center brace connection point to body of instrument
32 attachment to instrument (threaded screws)
34 back plate (threaded) (approx. 38 gms)
36 front plate (approx. 38 gms)
38 front plate cover (approx. 19 gms)
40 thumb screw (approx. 19 gms)
42 thumb screw thread
44 knurled edge like a coin
46 back plate opening (threaded to receive thumb screw 40)
48 back plate threads
50 ringed step configured to match contours of interior of center brace (ringed in this instance)
52 front plate opening
54 front plate notch
55 back plate notch
56 front plate cover notch
58 front plate flange layer configured to match the contours of the outside surface of the center brace
60 indicia
62 front plate cover opening
100 saxaphone bell attachment point for a center brace
102 saxaphone body attachment point for a center brace
104 bell
106 body

DETAILED DESCRIPTION

Accessory weights and kits for brass instruments are described herein and, in particular accessory weights and kits for brass instruments configured for attachment to a brace of a brass instrument. In use, the exemplary embodiments can provide more flexibility to a user of a brass woodwind instruments. As illustrated, an advantage of the described assemblies is to add mass to reduce sympathetic vibration. This is achieved by attaching the added mass to the center brace/connection of the saxophone between the bell and the body. It is noted that although the present embodiments are described to add mass to a ringed center brace of a saxophone, the present embodiments also include configurations adapted for attachment to other types of center braces for the saxophones and even other types of connection points which are effective to reduce sympathetic vibration. Additionally, the presented embodiments can also adjust the quality of the musical sound from the instrument. A tangible difference in low register response, and a generally darker timbre from the horn as well may be expected; similar to the effect of heavy mass neck screws. Articulation can be instantly easier as well as slurring to low register notes over large intervals.

In the present embodiments, the illustrated weight, or one/s with a slightly different shape and/or size will be able to be utilized on any modern saxophone with an -0-type or oval type brace/s. One/s will also be available to work with other types of braces.

In one embodiment, one or both of the weights are a permanent magnet, which means it is made from a material that is magnetized and creates its own persistent magnetic field. The opposing plate can also be magnetized or at least made from a material that strongly attract a magnet. Materials that can be magnetized, which are also the ones that are strongly attracted to a magnet, are called ferromagnetic (or ferrimagnetic). These include iron, nickel, cobalt, some alloys of rare earth metals, and some naturally occurring minerals such as lodestone.

Figure 2:
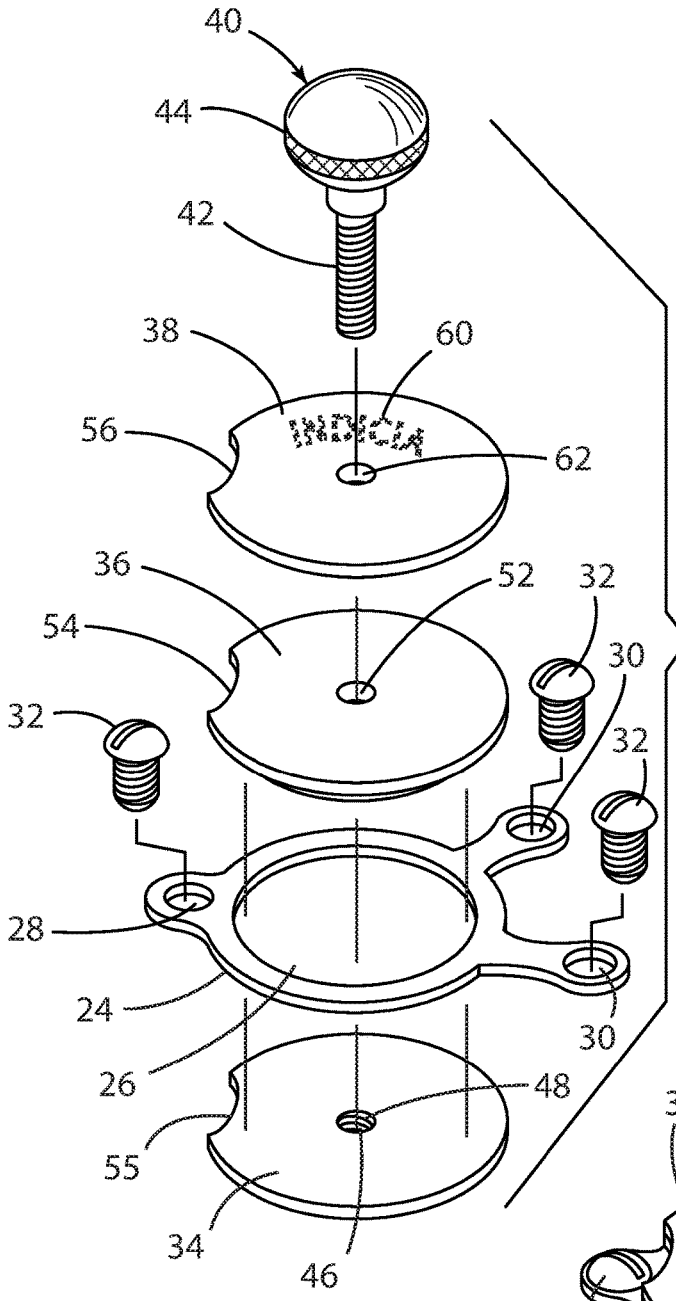
FIG. 2 illustrates an exploded top perspective view of the weight accessory of FIG. 1.
Figure 3:
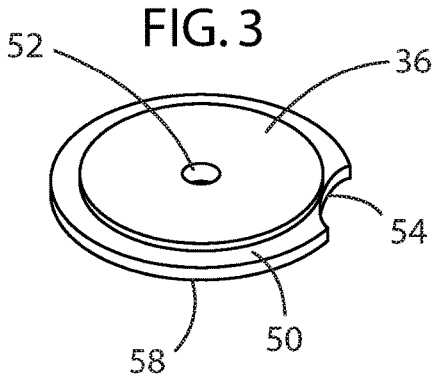
FIG. 3 illustrates a bottom view of an outer disk of the weight accessory of FIG. 1.
Figure 4:
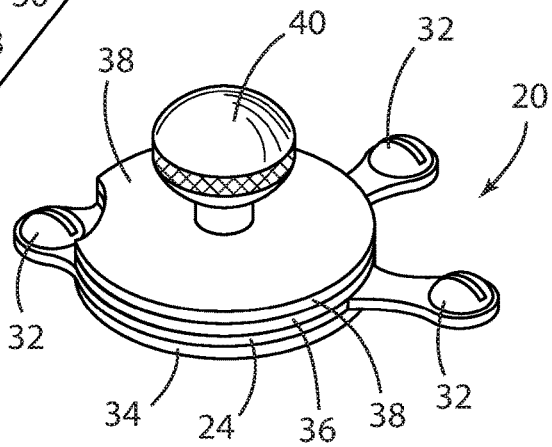
FIG. 4 illustrates a top perspective view of an assembled view of the weight accessory of FIG. 1.

FIGS. 1-4 provide an exemplary embodiment of the present weight assembly for a brass woodwind instrument or brass horn such as a saxophone 22 to dampen sympathetic vibrations and is generally indicated at 20. The weight of the assembly can be about 109 grams without brace and 128 grams with brace.

As illustrated, saxophone 22 has a center brace 24 (bell brace, ring design; bell to body brace) to attach bell 100 via bell attachment point 100 to body 106 via body attachment point (or points) 102 via threaded screws 32. Center brace 24 can be approximately 19 grams and provide attachment points 28 and 30 as shown. Center brace 24, as shown, also has a center brace ring opening 26. Center brace 24 functions to stabilize the bell.

Weight assembly 20 can have a back plate 34 having a hole 46 and weight approximately 38 grams. Hole 46 has threads 48 to receive threads 42 of thumb screw 40. Thumb screw 40 can weigh about 19 grams and have a knurled edge such as striations similarly used in coinage to allow a user to tighten and loosen (install or remove) the weight assembly 20. Back plate 34 can have a rounded edge from its exposed surface to its edge. And notch 55 to not obstruct attachment to the instrument.

A front plate 36 of approximately 38 grams can also be provided having an opening 52, which is larger in diameter than the thickness of the threads on threads 42 on screw 40. A notch 54 can also be provided to not obstruct attachment to the instrument. Front plate 36 can also have a front plate flange layer 50 configured to match the contours of the inside opening of center brace 24. Flange layer 50 can be configured to be the thickness of brace 24 so that the interior surface of front plate 36 is adjacent (touching or nearly touching) to the interior surface of back plate 34. The configuration of front plate 36 may be of different sizes, shapes and/or designs. This would allow for artistic license on the look of the top plate, which may even have indicia engraved thereon.

A front plate cover 38 may also be provided and weigh approximately 19 grams. Front plate cover may also contain a notch 56 similar as described above and can allow application of indicia 60. Indicia can allow a user to make his instrument more easily identifiable, more aesthetically pleasing; or to provide logos for promotions. This customization can be easily switched by the user so that in a kit form several front plate covers may be permited.

It is noted that specific weights and ranges were provide for illustrative purposes only. Actual weights of individual pieces can vary widely so long as the combined weight of the assembly weigh in use is about 100 to 140 grams. For example the front cover plate could even be made of a plastic material or even a peelable label so long as more weight is added to the other plates or even the screw.

Figure 5:
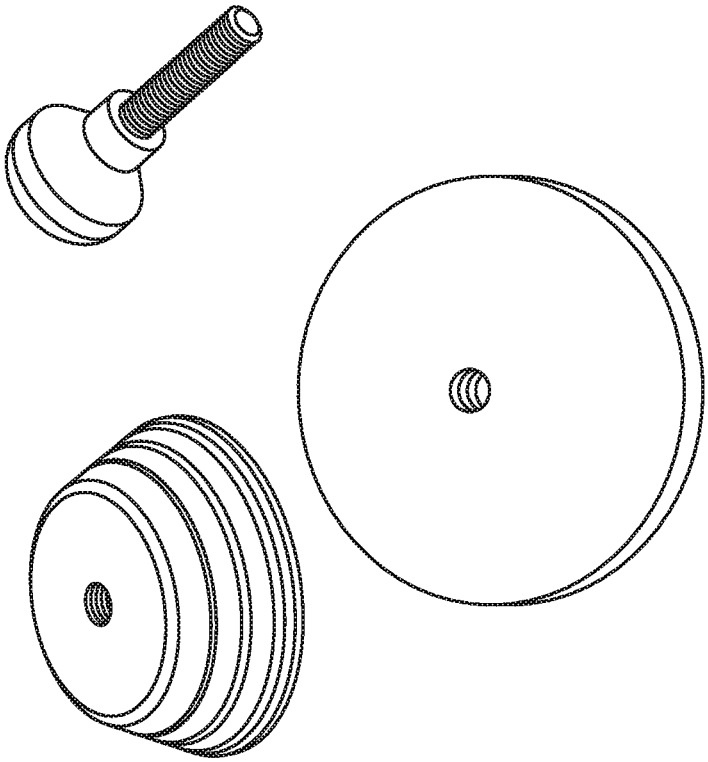
FIGS. 5-10 illustrate photographs of an alternate embodiment of a weight accessory for a brass instrument.
Figure 6:
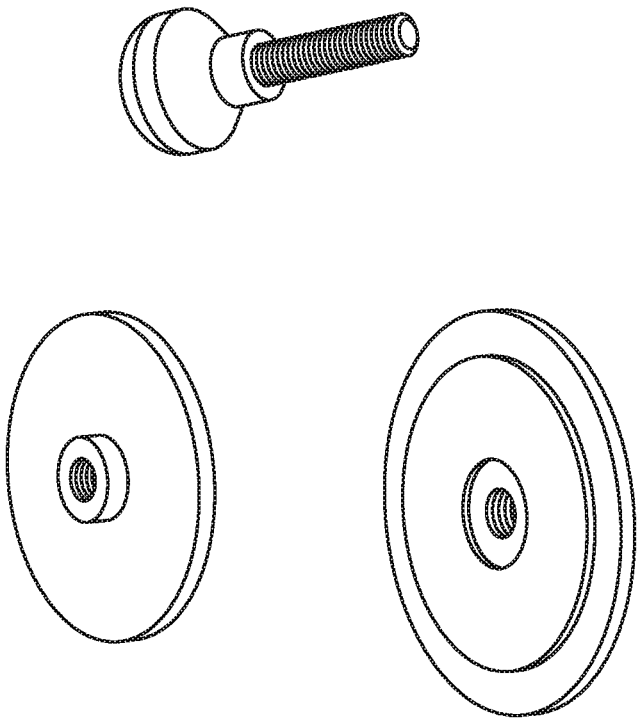
Figure 7:
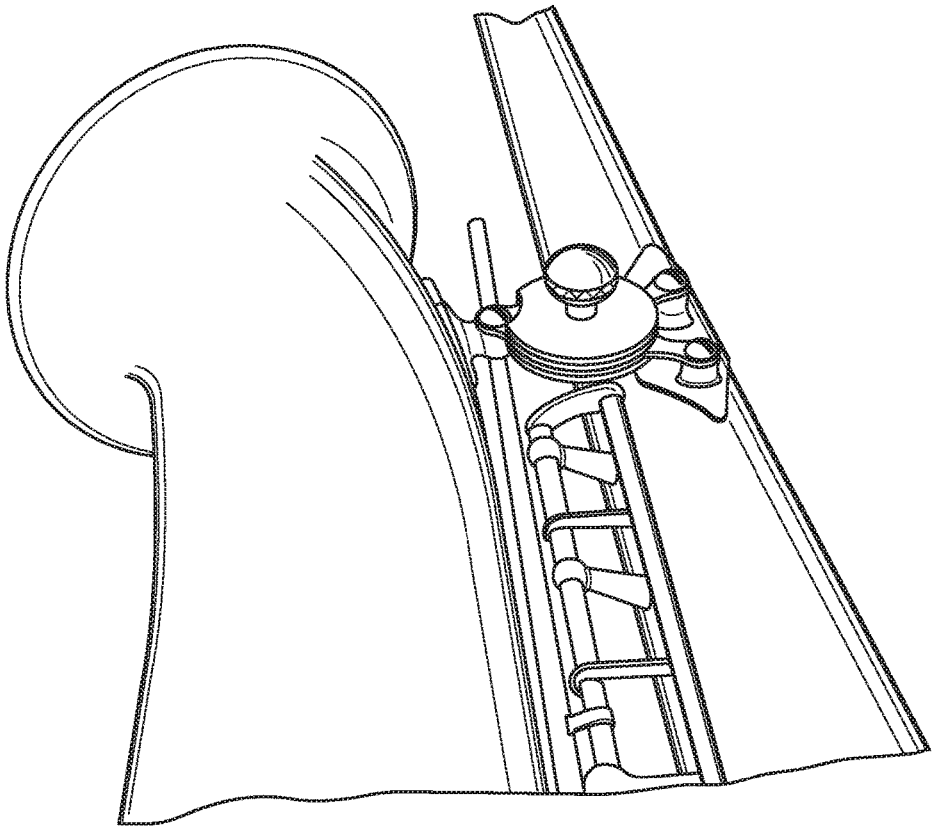
Figure 8:
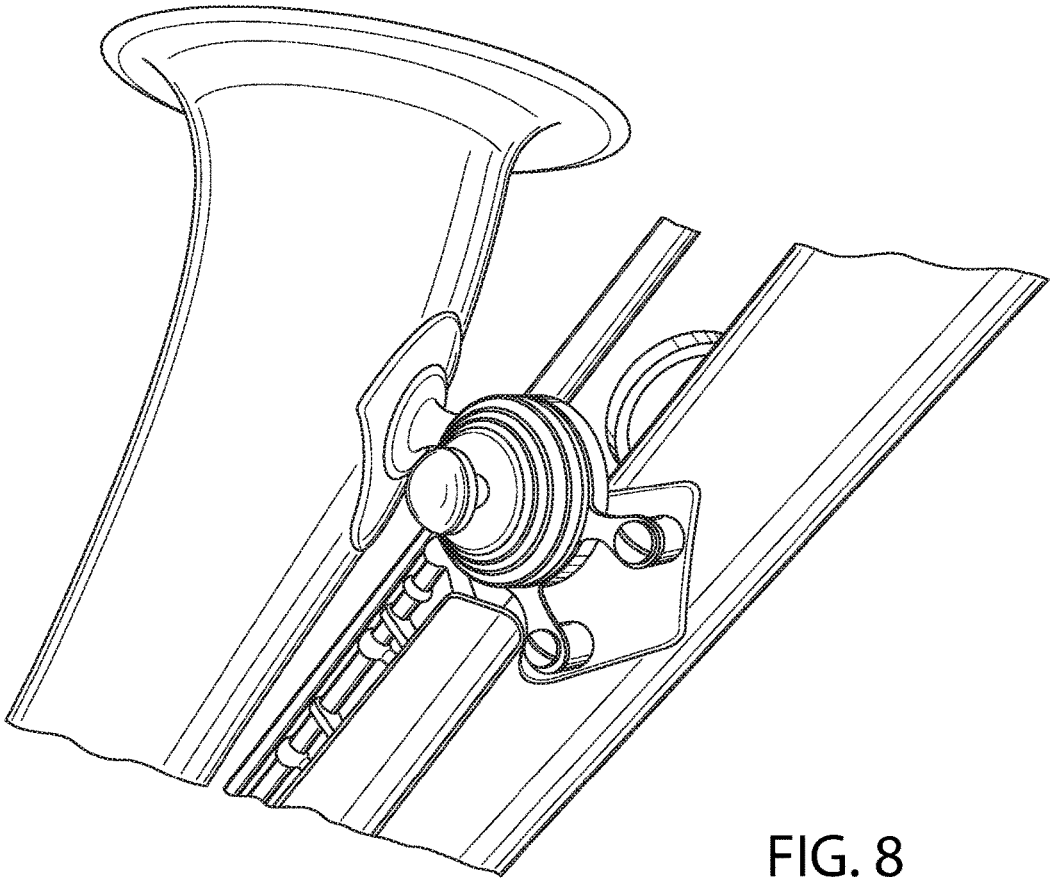
Figure 9:
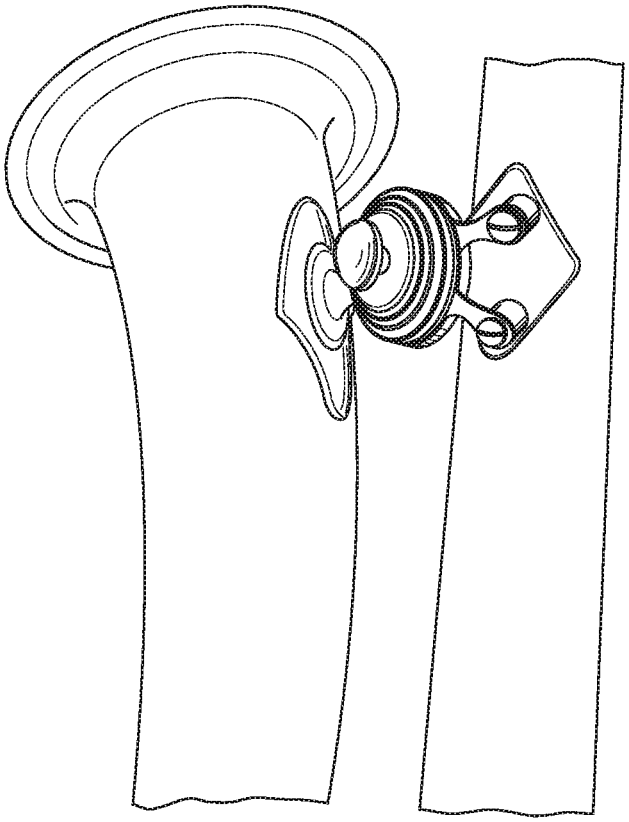
Figure 10:
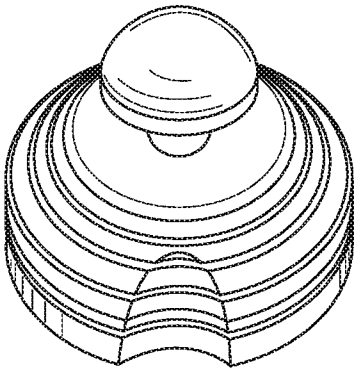

FIGS. 5-10 show an additional embodiment according to another approach.

While the invention herein disclosed has been described by means of specific embodiments, examples and applications thereof, numerous modifications and variations could be made thereto by those skilled in the art without departing from the scope of the invention set forth in the claims.

I claim:

1. A weight assembly to reduce sympathetic vibration of a brass instrument, comprising:

a first weight disposed on a first side of a center brace for a saxophone between the bell and the body;

a second weight disposed on a second side of a center brace for a saxophone between the bell and the body;

a connector to attach the first weight to the second weight, the connector configured to extend through a bore of the center brace;

wherein the weight assembly has a weight in the range of 70 grams to 150 grams.

2. The weight assembly of claim 1, wherein the connector is a screw that extends through a bore defining an opening in the first weight, through the bore of the center brace, and attached to the second weight by attachment through a threaded bore of the second weight.

3. The weight assembly of claim 1, wherein the connector is a magnetic force from the first weight and second weight being made from a ferromagnetic material and at least one of the first weight and second weight are a permanent magnet, the first weight and the second weight configured to be adjacent to each other within at least a portion of the opening of the center brace.

4. The weight assembly of claim 1, further comprising a removable cover layer over the first weight.

5. The weight assembly of claim 4, further comprising indicia on an outer surface of the front plate cover.

6. The weight assembly of claim 1, wherein the weight is in the range of about 100 grams to 120 grams.

7. The weight assembly of claim 1, wherein the combined weight of the assembly and the center brace is in the range of about 100 grams to 160 grams.

8. The weight assembly of claim 7, wherein the combined weight of the assembly and the center brace is in the range of about 115 grams to 145 grams.

9. A weight assembly to reduce sympathetic vibration of a brass instrument, comprising:

a first weight disposed on a first side of a center brace for a saxophone between the bell and the body;

a second weight disposed on a second side of a center brace for a saxophone between the bell and the body;

a connector to attach the first weight to the second weight, the connector configured to extend through a bore of the center brace;

wherein the connector is a screw that extends through a bore defining an opening in the first weight, through the bore of the center brace, and attached to the second weight by attachment through a threaded bore of the second weight.

10. A weight assembly to reduce sympathetic vibration of a brass instrument, comprising:

a first weight disposed on a first side of a center brace for a saxophone between the bell and the body;

a second weight disposed on a second side of a center brace for a saxophone between the bell and the body;

a connector to attach the first weight to the second weight, the connector configured to extend through a bore of the center brace;

wherein the connector is a magnetic force from the first weight and second weight being made from a ferromagnetic material and at least one of the first weight and second weight are a permanent magnet, the first weight and the second weight configured to be adjacent to each other within at least a portion of the opening of the center brace.

* * * * *